US010704311B1

(12) United States Patent
Collene et al.

(10) Patent No.: US 10,704,311 B1
(45) Date of Patent: Jul. 7, 2020

(54) APPLIANCE LID HINGE

(71) Applicant: Mansfield Engineered Components, Inc., Mansfield, OH (US)

(72) Inventors: James J. Collene, Bucyrus, OH (US); Nicholas R. SirLouis, Seville, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 0 days.

(21) Appl. No.: 15/997,196

(22) Filed: Jun. 4, 2018

Related U.S. Application Data

(63) Continuation of application No. 15/890,130, filed on Feb. 6, 2018, now abandoned.

(60) Provisional application No. 62/455,185, filed on Feb. 6, 2017.

(51) Int. Cl.

| | |
|---|---|
| ***E05F 1/08*** | (2006.01) |
| ***E05F 3/18*** | (2006.01) |
| ***E05F 1/12*** | (2006.01) |
| ***E05F 3/20*** | (2006.01) |

(52) U.S. Cl.
CPC ..... *E05F 3/18* (2013.01); *E05F 1/1261* (2013.01); *E05F 3/20* (2013.01); *E05Y 2900/312* (2013.01)

(58) Field of Classification Search
CPC ..... Y10T 16/5383; Y10T 16/54024; Y10T 16/54026; Y10T 16/54029; Y10T 16/5404; Y10T 16/5406; Y10T 16/5407; Y10T 16/544; E05F 3/20; E05F 3/14; E05F 3/16; E05F 3/18; E05F 3/22; E05F 1/12; E05F 1/1261; E05F 1/1284; E05F 5/02; E05D 3/122; E05D 2/02; E05D 11/1007; E05Y 2201/21; E05Y 2201/218; E05Y 2201/48; E05Y 2201/266; E05Y 2800/26; E05Y 2800/465; E05Y 2800/674; E05Y 2900/312; D06F 39/12
See application file for complete search history.

(56) References Cited

U.S. PATENT DOCUMENTS

| | | | | |
|---|---|---|---|---|
| 2,479,437 A | | 8/1949 | Vigmostad et al. | |
| 3,256,554 A | | 6/1966 | Turner | |
| 3,496,595 A | * | 2/1970 | Larson | E05F 1/1261 16/289 |
| 3,737,947 A | | 6/1973 | Little | |
| 3,763,519 A | * | 10/1973 | Favre | E05F 1/105 16/72 |
| 4,947,516 A | | 8/1990 | Kretchman et al. | |

(Continued)

*Primary Examiner* — Chuck Y Mah
(74) *Attorney, Agent, or Firm* — Fay Sharp LLP

(57) ABSTRACT

An appliance lid hinge assembly includes a cam arm pivotally connected a base. A cam arm control system includes a spring rod adapted to move in a sliding reciprocal manner. A spring urges the spring rod toward an extended position. The spring rod is movable toward a retracted position. The cam arm is engaged with the spring rod through a cam follower such that: (i) pivoting movement of the cam arm in an opening direction corresponds with movement of the spring rod from the retracted position toward the extended position; and, (ii) pivoting movement of the cam arm in a closing direction opposite the opening direction corresponds with movement of the spring rod from the extended position toward the retracted position. An optional damper exerts a damping force on the spring rod or other part of the cam arm control system when the cam arm moves in a closing direction.

12 Claims, 14 Drawing Sheets

(56) References Cited

U.S. PATENT DOCUMENTS 5,269,043 A 12/1993 Yang
6,397,836 B1 6/2002 Pelletier et al.
6,415,477 B1 7/2002 Hosaka et al.
6,442,799 B1 9/2002 Duarte et al.
6,679,572 B2 1/2004 Sears
6,766,563 B2 7/2004 Lee
6,845,545 B2 1/2005 Han et al.
7,552,509 B2 6/2009 Chen et al.
7,676,888 B2 3/2010 Vanini
7,861,371 B2 1/2011 Kim
7,900,320 B2 * 3/2011 Katsumata ..... B41J 29/13 16/286
7,937,807 B2 5/2011 Bereznai
8,096,455 B2 1/2012 Viklund et al.
8,201,304 B2 * 6/2012 Steurer ..... E05F 1/1261 126/194
8,443,489 B2 5/2013 Sir Louis
8,533,914 B2 * 9/2013 Vanini ..... E05F 1/1261 16/286
8,683,653 B2 4/2014 Bettinzoli
8,991,010 B2 3/2015 Brunnmayr
9,080,365 B2 7/2015 Collene et al.
9,121,211 B1 9/2015 White et al.
9,157,262 B2 * 10/2015 Lee ..... E05D 3/12
9,169,681 B2 10/2015 Cooper et al.
9,181,737 B1 11/2015 Kadus et al.
9,181,741 B2 11/2015 Bettinzoli
9,394,645 B2 7/2016 Park et al.
9,625,160 B2 4/2017 Xiao
2003/0172920 A1 * 9/2003 Gronbach ..... E05D 7/12 126/197
2006/0053589 A1 3/2006 Vanini
2007/0251052 A1 11/2007 Pyo
2009/0064458 A1 3/2009 Vanini
2010/0281650 A1 11/2010 Kleemann et al.
2011/0094056 A1 4/2011 Lautenschlager
2011/0146654 A1 6/2011 Basavalingappa Mudbasal et al.
2011/0298349 A1 12/2011 Sutterlutti
2013/0239364 A1 9/2013 Sir Louis
2014/0345082 A1 * 11/2014 Collene ..... E05F 1/1058 16/58
2015/0354261 A1 12/2015 Dora
2016/0230438 A1 * 8/2016 Collene ..... E05F 1/1058
2017/0030125 A1 2/2017 Bacchetti
2017/0122020 A1 5/2017 Collene
2017/0130502 A1 5/2017 Collene
2017/0254133 A1 9/2017 Liang et al.
2018/0010377 A1 1/2018 Bacchetti
2018/0238093 A1 * 8/2018 Rommelmann ..... E05F 5/02
2019/0024905 A1 * 1/2019 White ..... F24C 15/023

* cited by examiner

APPLIANCE LID HINGE

CROSS-REFERENCE TO RELATED APPLICATIONS

This application is a continuation of co-pending U.S. application Ser. No. 15/890,130 filed Feb. 6, 2018, which claims priority from and benefit of the filing date of U.S. provisional application Ser. No. 62/455,185 filed on Feb. 6, 2017, and the entire disclosure of each of said prior applications is hereby expressly incorporated by reference into the present specification.

BACKGROUND

Appliance lid hinge assemblies that operatively connect a cover or lid to a body must provide the desired operational characteristics and durability while fitting into a confined space that often has an irregular shape. Furthermore, these hinge assemblies are subjected to heavy use, temperature variations, moisture, vibrations, and other harsh operating conditions, and are nonetheless expected to last for many years without requiring maintenance or repair.

Furthermore, consumers expect appliance lids to have a certain "feel" during opening and closing. For example, the appliance lid must be self-supporting when located in an opened position, even when the lid cannot be opened fully to 90 degrees or more due to an overhead obstruction. Consumers also often desire that the lid counterbalances in a partially opened position such that it will remain stationary without user manual support when partially opened, and consumers desire that the force required to open the lid not be excessive to accommodate people with limited strength or dexterity. In addition, it is becoming increasingly desirable by many consumers for such appliance lids to exhibit a soft-close or slow-close characteristic in which the lid closes in a slow, controlled manner even when the lid is allowed to close under its own weight by force of gravity.

SUMMARY

In accordance with one aspect of the present development, an appliance lid hinge assembly includes a base and a cam arm pivotally connected to the base and adapted to be connected to an associate appliance lid. A cam arm control system includes a spring rod engaged with the base and adapted to move relative to the base in a sliding reciprocal manner along a spring rod axis. A spring exerts a biasing force on the spring rod that urges the spring rod toward an extended position, wherein the spring rod is movable against the biasing force from the extended position toward a retracted position. The cam arm is operatively engaged with the spring rod through a cam follower such that: (i) pivoting movement of the cam arm in an opening direction corresponds with movement of the spring rod from the retracted position toward the extended position; and, (ii) pivoting movement of the cam arm in a closing direction opposite the opening direction corresponds with movement of the spring rod from the extended position toward the retracted position.

In accordance with another aspect of the present development, a damper is connected to the base and exerts a damping force on the spring rod or other part of the cam arm control system when the cam arm moves in a closing direction.

DETAILED DESCRIPTION

Figure 1:
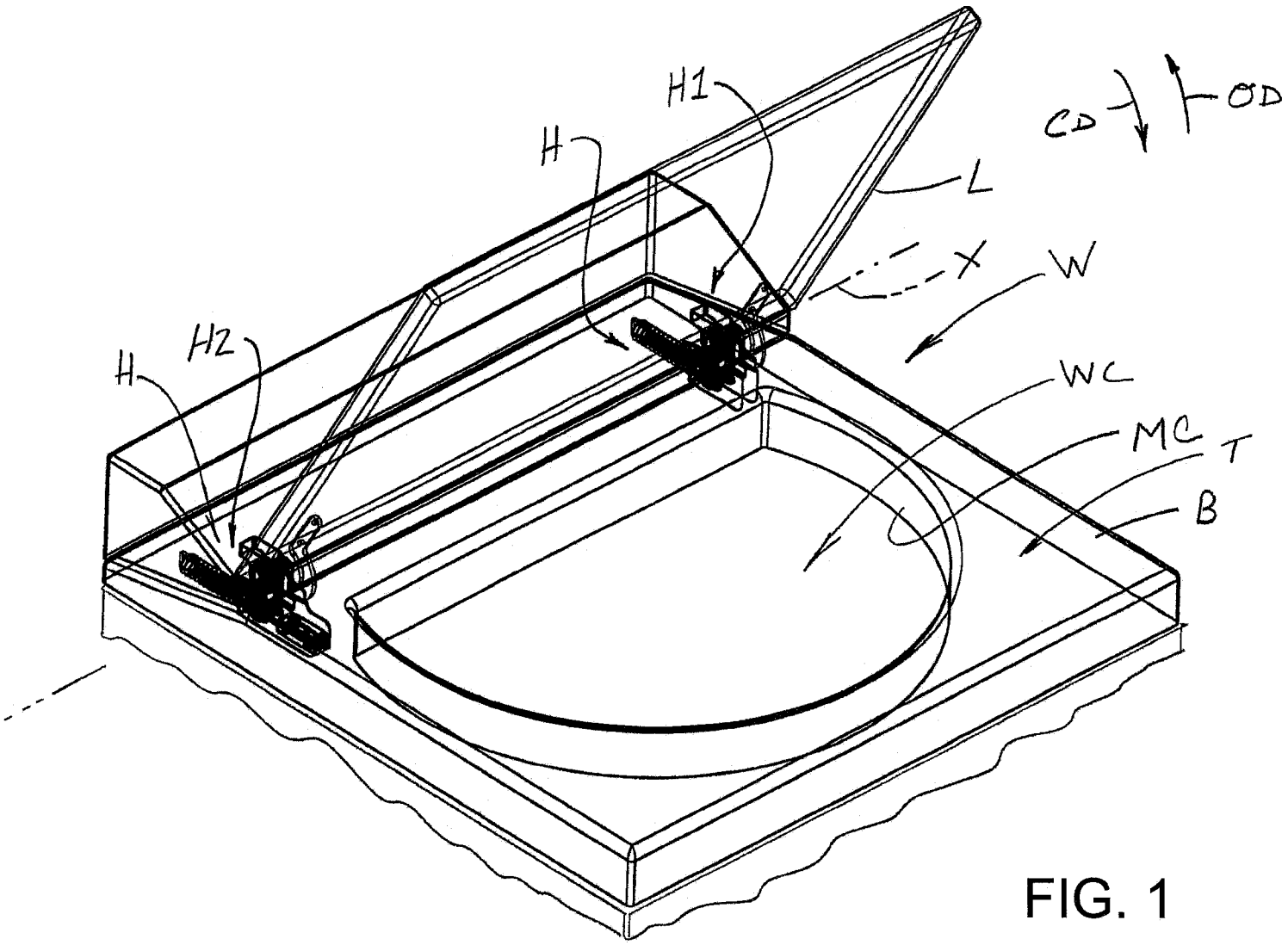
FIG. 1 partially illustrates a clothes washer, clothes dryer, or other household appliance including at least one hinge assembly provided in accordance with the present development.

FIG. 1 partially illustrates a clothes washer, clothes dryer, or other household appliance W. The appliance includes a body B that includes or defines a washing, drying or other appliance chamber WC. The chamber WC comprises an access opening or mouth MC that opens through a wall of the body B. In the non-limiting example of FIG. 1, the mouth MC of the chamber WC opens through the top wall T of the body B, but the mouth MC can open through any other wall of the body B.

The appliance W further comprises a lid L that is pivotally connected to the body B by one or more hinge assemblies H (two such hinge assemblies H1,H2 are shown in FIG. 1). The hinge assemblies H1,H2 operatively connect the lid L to the body B such that the lid L pivots about a pivot axis X between an opened position, such as the intermediate opened position shown in FIG. 1 in which the lid L is pivoted away from the mouth MC in an opening direction OD to allow access to the chamber WC via mouth MC, and a closed position (not shown) in which the lid L is pivoted in an opposite, closing direction CD to a position where the lid L lies adjacent the top or other wall T through which the mouth MC opens so that the lid L covers the mouth MC and blocks access to the chamber WC via mouth MC. The pivot axis X is horizontally oriented in the example of FIG. 1, but the pivot axis can be vertically or otherwise oriented depending upon the wall of the body in which the chamber mouth MC is located.

The hinge assemblies H1,H2 are respectively connected adjacent opposite right and left lateral sides of the appliance body B and are also respectively connected adjacent opposite right and left lateral sides of the lid L. In the example of FIG. 1, the hinge assembly H1 is constructed and provided in accordance with a first embodiment of the present development, and the hinge assembly H2 is constructed, and provided in accordance with a second embodiment of the present development. Alternatively, both hinge assemblies can be provided as a hinge assembly H1, both hinge assemblies can be provided as a hinge assembly H2, or only one of the hinge assemblies H1,H2 can be used in combination with a conventional hinge assembly (not shown).

Figure 2:
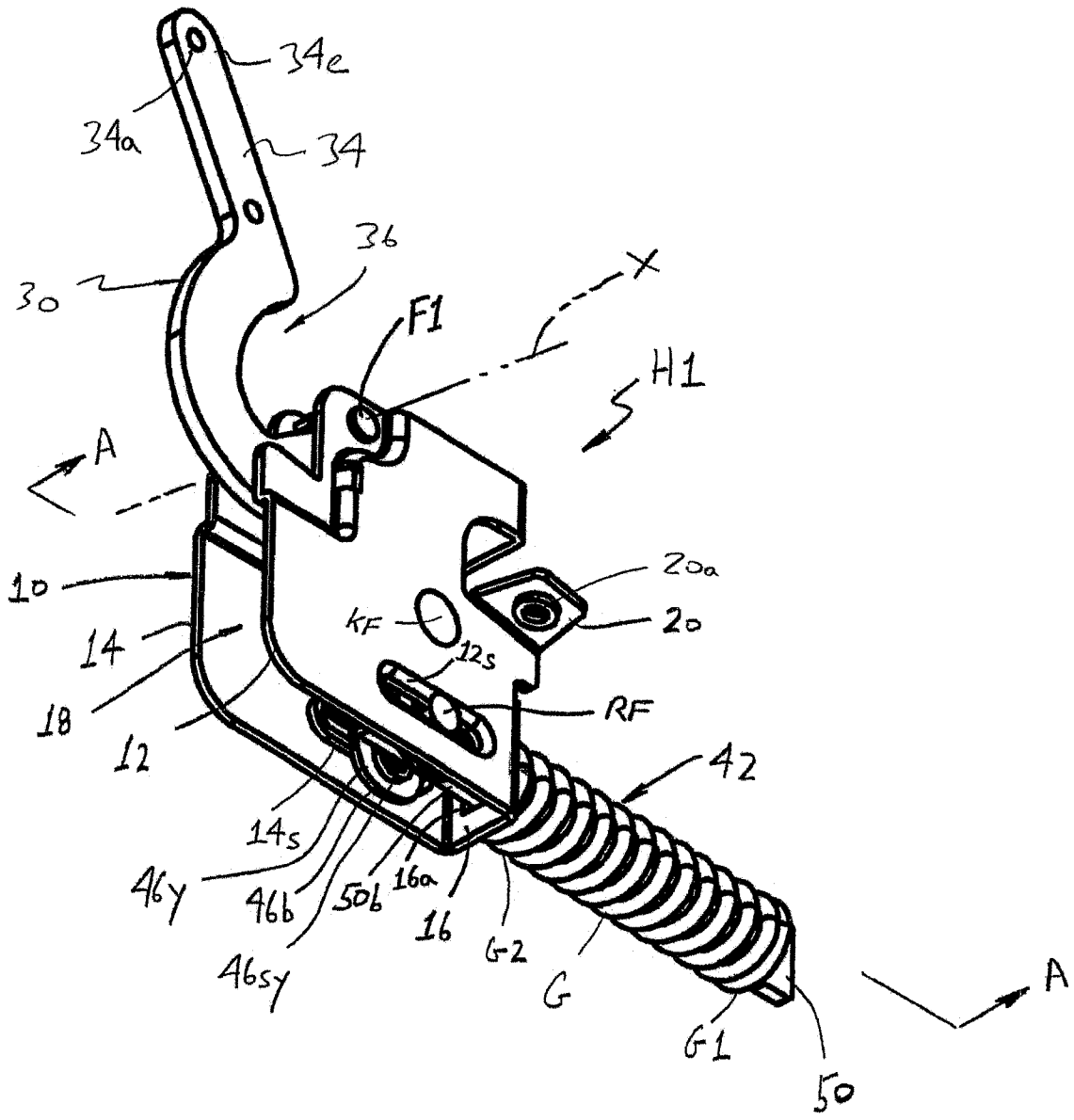
FIG. 2 provides an isometric view of a hinge assembly according to a first embodiment of the present development, with the hinge assembly arranged in an intermediate opened position corresponding to the intermediate opened position of the appliance lid.
Figure 2A:
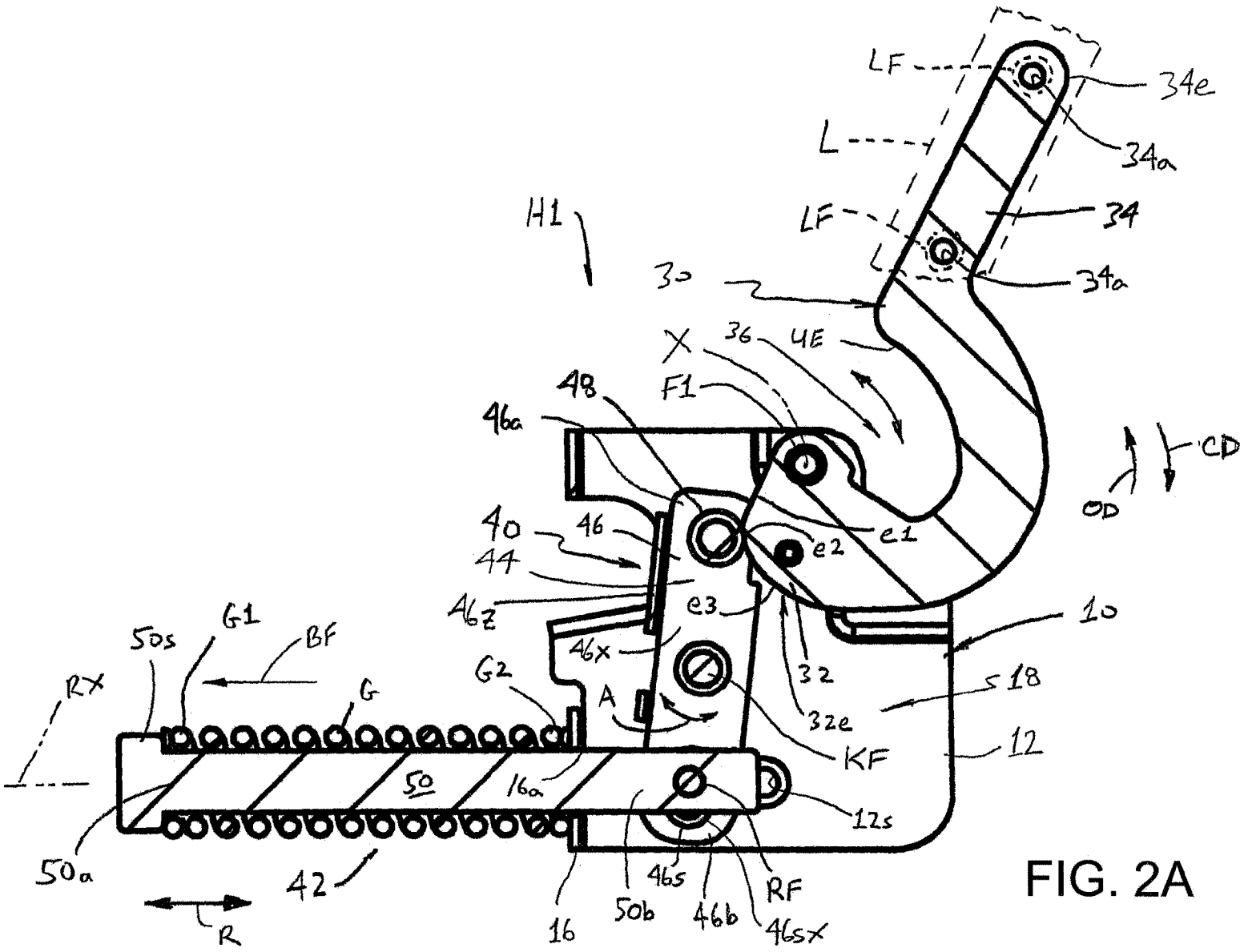
FIG. 2A is a section view of the hinge assembly as taken at A-A of FIG. 2.
Figure 2B:
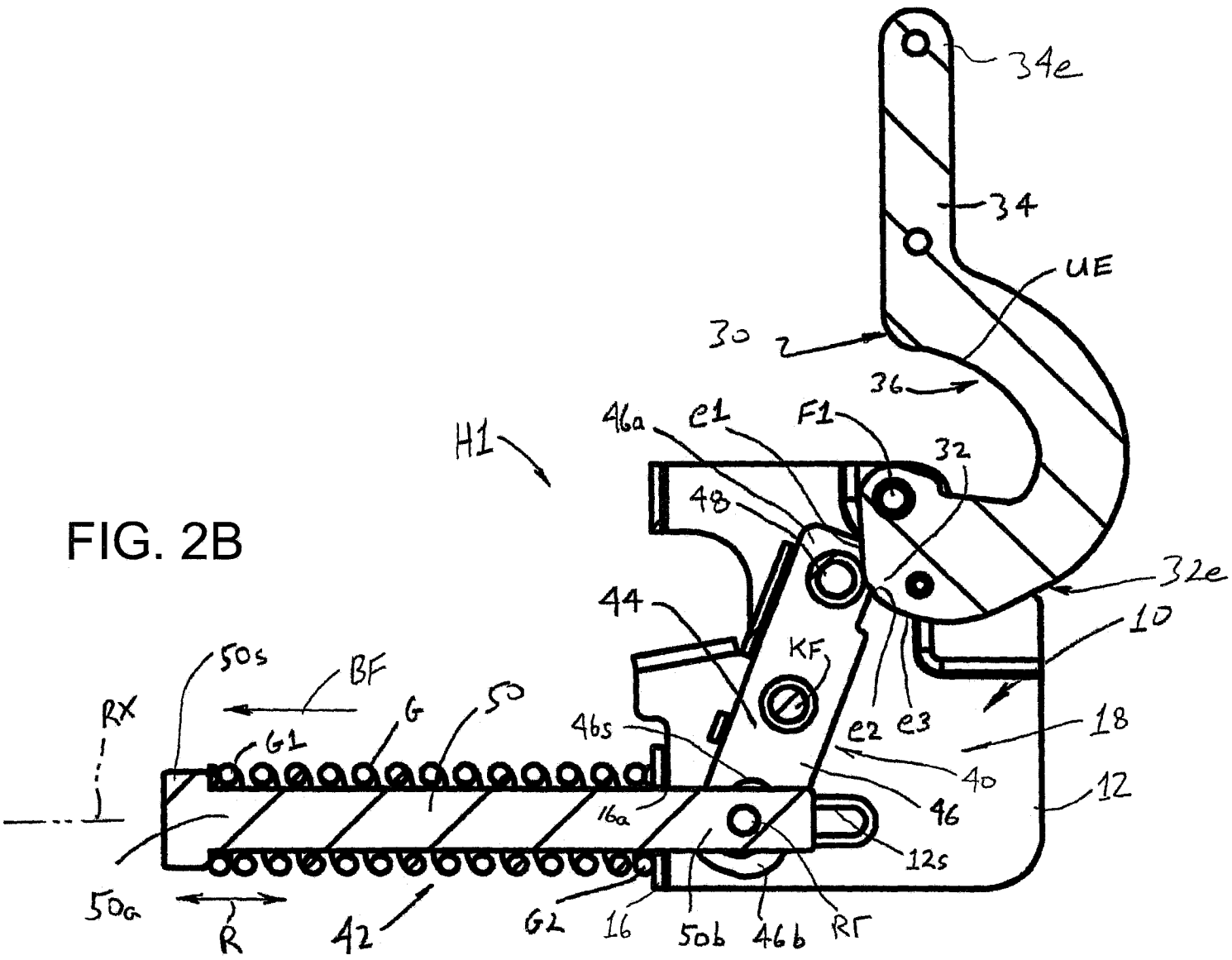
FIGS. 2B and 2C correspond to FIG. 2A but show the hinge assembly arranged in fully opened and closed positions, respectively, corresponding to fully opened and closed positions of the appliance lid.
Figure 2C:
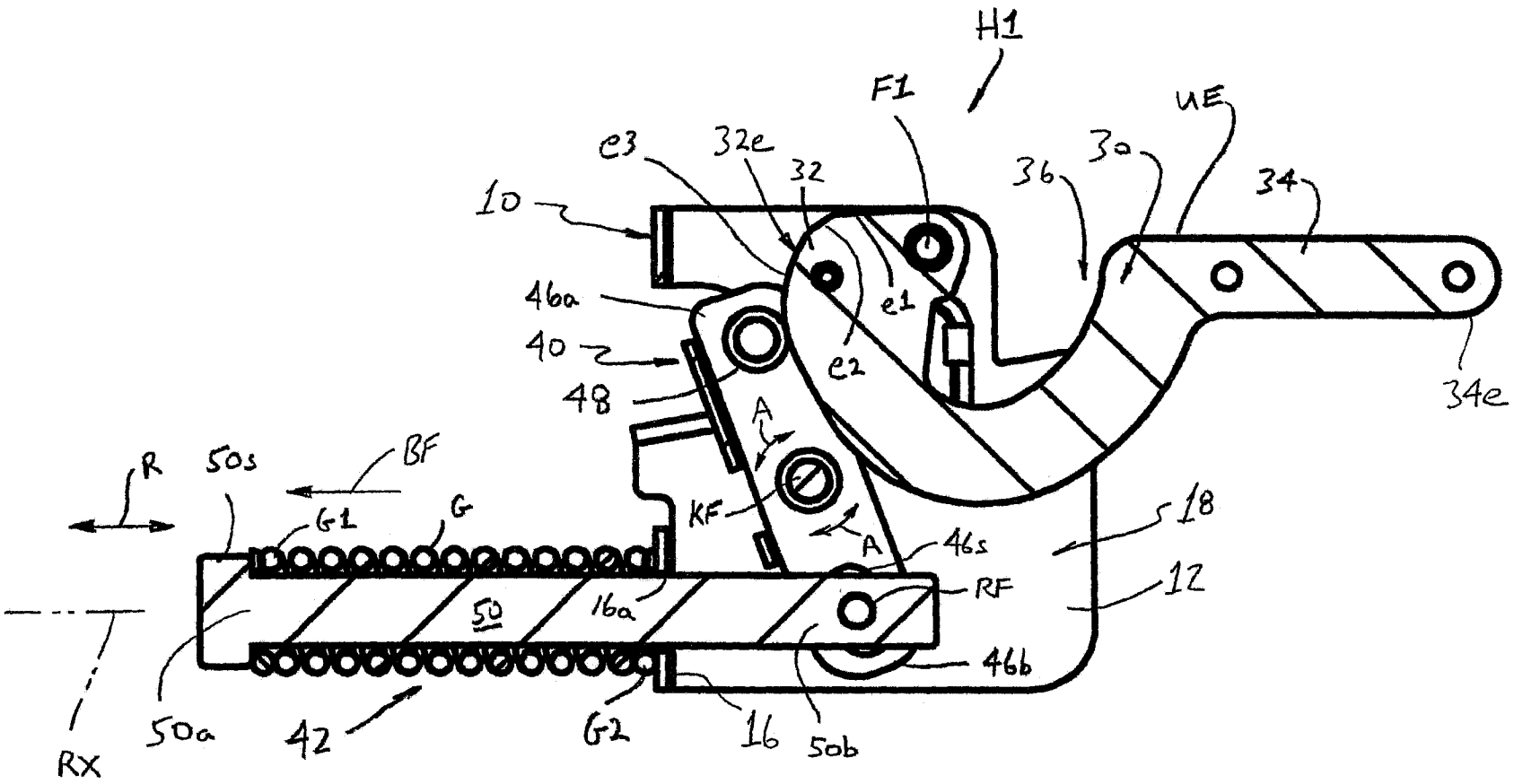

FIG. 2 provides an isometric view of the hinge assembly H1, is a hinge assembly constructed in accordance with a first embodiment of the present development. The hinge assembly H1 as shown in FIG. 2 is arranged or configured in an intermediate opened position corresponding to the intermediate opened position of the lid L shown in FIG. 1. FIG. 2A is a section view of the hinge assembly H1 as taken at A-A of FIG. 2. FIGS. 2B and 2C correspond to FIG. 2A but respectively show the hinge assembly arranged in fully opened and closed positions that correspond respectively to fully opened and closed positions of the lid L. In one example, the intermediate opened position of the lid L is provided when the lid is located at an angle of between 45 degrees and 75 degrees (e.g., 70 degrees as shown) relative to the (top) wall T in which the mouth MC is defined, and the fully opened position of the appliance lid L is similar to the intermediate opened position shown in FIG. 1, but the lid L is pivoted additionally away from the (top) wall T and chamber mouth MC in the opening direction OD to a position where the lid L is oriented at an angle of more than 75 degrees (e.g., 90 degrees) relative to the wall T in which the mouth MC is defined. As noted above, in the closed position, the lid L is abutted with or otherwise located adjacent the wall T in which the mouth is defined so that the lid L covers the mouth MC and blocks access to the chamber WC.

Referring to all of FIGS. 2-2C, the hinge assembly H1 comprises a base 10 adapted to be connected to the appliance body B adjacent the chamber mouth MC as shown in FIG. 1. In the example of FIG. 1, the base 10 comprises a one-piece structure provided by a metal stamping or similar structure, although the base 10 can alternatively comprise a multi-piece metallic structure or a one-piece or multi-piece molded polymeric structure or any other suitable material. The base 10 comprises parallel, spaced-apart first and second side walls 12,14 and an end wall or transverse wall 16 that extends transversely between and connects the first and second side walls 12,14. The end wall 16 need not be located at the end of the base 10 and can be located at any axial location between the side walls 12,14. An open channel or space 18 is defined between the side walls 12,14 and end wall 16. The base 10 comprises one or more mounting tabs 20 each including a slot or aperture 20*a* by which it is secured to the appliance body B using suitable fasteners. In the illustrated embodiment of FIG. 1, the base 10 is secured to the appliance body B adjacent a rear edge of the chamber mouth MC.

The hinge assembly H1 further comprises a cam arm 30 that is pivotally connected to the base 10 using a main pivot fastener F1 such as a rivet, pin, or other suitable fastener. The cam arm 30 rotates about the main pivot fastener F1 and about the pivot axis X, i.e., the pivot axis X is coincident with the center of the main pivot fastener F1. In the illustrated example, an inner end of the cam arm 30 is located in the space 18 between the first and second side walls 12,14 of the base 10, and the main pivot fastener F1 extends through both side walls 12,14 and through the cam arm 30 such that the main pivot fastener F1 supports the cam arm 30 for angular rotation relative to the base 10 about the pivot axis X.

As shown in FIGS. 2A-2C, the cam arm 30, which is preferably a one-piece metal structure, comprises a cam or cam portion 32 located adjacent the base 10 and an outer mounting portion 34 that is connected to and projects outwardly from the cam portion 32 and away from the base 10. The appliance lid L is connected to the mounting portion 34 by any suitable mechanical connection, e.g., using rivets, screws, a mating connection, and/or other suitable lid fasteners LF that extend through one or more apertures 34*a* located in the mounting portion 34 (FIG. 2A).

The mounting portion 34 of the cam arm 30 preferably comprises a U-shaped region where the mounting portion 34 is curved so as to include an open recess or notch 36 in its first or upper edge UE between the cam portion 32 and an outer end 34*e* of the mounting portion 34. More particularly, the notch 36 is located and opens between the main pivot fastener F1 and the outer end 34*e* of the arm portion 34. The notch 36 is provided to accommodate and provide clearance for portions of the appliance body B that would otherwise be contacted by the cam arm 30 when the lid L is moved toward its fully opened position.

The cam portion 32 of the cam arm 30 comprises a contoured cam profile edge 32*e* that extends from a location adjacent the main pivot fastener F1 away from the notch 36. More particularly, the cam profile edge 32*e* comprises a first portion e1 that extends away from a location adjacent the main pivot fastener F1 and away from the notch 36, a second portion or detent portion e2 connected to the first portion e1 with the first portion e1 located between the detent portion e2 and the main pivot fastener F1, and a third portion e3 connected to the detent portion e2 such that the detent portion is located between the first portion e1 and the third portion e3. In the illustrated example, the first portion e1 is flat, the detent portion e2 comprises a concave recess or dwell location, and the third portion e3 is smoothly and continuously convexly curved.

The hinge assembly H1 further comprises a cam arm control subassembly or system 40 connected to the base 10 for exerting a biasing force on and controlling movement of the cam arm 30 when the cam arm 30 is rotated or pivoted about the main pivot fastener F1 during movement of the appliance lid L to and between its closed and opened positions. As shown herein, the cam arm control system 40 comprises a biasing spring system 42 and a connector linkage 44, both of which are connected to the base 10. The connector linkage 44 comprises at least one connector link 46 that is movably connected to the base 10 and that transfers force between the cam arm 30 and the biasing spring system 42. In the illustrated example, the connector linkage 44 comprises a single connector link 46 that is pivotally connected to the base 10 in the space 18 between the side walls 12,14. The connector link 46 comprises an upper or first end 46*a* and an opposite lower or second end 46*b*, and is pivotally connected to the base 10 by a rivet, pin, or other link fastener KF that extends between the base side walls 12,14 and through the connector link 46 between its opposite first and second ends 46*a*,46*b*. As such, the connector link 46 pivots in a reciprocal manner about the link fastener KF on an arc A such that the opposite first and second ends 46*a*,46*b* of the connector link 46 move in opposite directions about the link fastener KF with respect to the spring rod axis RX. The connector link 46 can be a single link, but the illustrated connector link 46 comprises a U-shaped double-walled link or channel member comprising first and second parallel, spaced-apart link sidewalls 46*x*,46*y* connected together by a transverse end wall 46*z* such that a space is defined between the spaced-apart link sidewalls 46*x*,46*y*.

The first end 46*a* of the connector link 46 includes a cam follower 48 that is connected to or formed as part of the connector link 46. In the illustrated example, the follower 48 comprises a pin, rivet, slide member, bushing, roller or other non-rotating or rotating structure that is connected to the first end 46*a* of the connector link using a rivet or other fastener (the follower 48 comprises a rotatable roller in the example of FIGS. 2A-2C). Alternatively, the cam follower 48 can be provided by a part of the connector link 46, such as a tab, flange, head, or other portion that is provided as a one-piece structure with the connector link 46 or otherwise connected to the link 46.

The opposite second end 46*b* of the connector link 46 is operatively connected to the biasing spring system 42. The biasing spring system 42 comprises a spring rod 50 including a first or outer end 50*a* and an opposite second or inner end 50*b*. The spring rod 50 is slidably connected to the base 10. In the embodiment of FIGS. 2-2C, the spring rod 50 is slidably located in an aperture 16*a* defined in the transverse wall 16 of the base 10 such that the first end 50*a* of the spring rod is located external to the base 10 (external to the space 18 defined between the first and second side walls 12,14 of the base 10) and the second end 50*b* of the spring rod is located in the space 18 defined between the first and second side walls 12,14 of the base. The second end 50*b* of the spring rod 50 is pivotally connected to the second end 46*b* of the connector link 46. In the illustrated embodiment, the second end 50*b* of the spring rod 50 is located or sandwiched between the spaced-part side walls 46*x*,46*y* of the connector link 46. The second end 46*b* of the connector link 46 includes an elongated slot 46*s* and a pin, rivet, or other rod fastener RF extends through the second end 50*b* of the spring rod and also through the slot 46*s*. The slot 46*s* accommodates relative sliding movement between the connector link 46 and the spring rod 50 as the connector link 46 rotates on the arc A so that the spring rod 50 need not pivot relative to the base 10. Because the illustrated connector link 46 includes spaced-apart side walls 46*x*,46*y*, the slot 46*s* comprises aligned slot portions 46*sx*,46*sy* defined respectively in the spaced-apart connector link side walls 46*x*,46*y* that cooperate to define the slot 46*s*. Alternatively, the slot 46*s* is omitted and the second/inner end 50*b* of the spring rod 50 is simply pivotally connected to the second end 46*b* of the connector link 46, in which case the spring rod 50 is pivotable or otherwise moveable relative to the base 10 to accommodate the rotational movement of the connector link 46 on the arc A. As such, as further described below, the cam arm 30 is operatively engaged with the spring rod 50 by way of the cam arm control system 40, including the connector linkage 44.

The spring rod 50 is preferably restricted to reciprocal linear sliding movement along its longitudinal spring rod axis RX relative to the base 10 as indicated by the arrow R. In the illustrated embodiment, the opposite first and second side walls 12,14 of the base include respective elongated slots 12*s*,14*s* that are aligned or registered with each other and that are elongated along respective axes that lies parallel to the spring rod axis RX. In this embodiment, the opposite first and second ends of the rod fastener RF extend through and are located in the respective first and second slots 12*s*,14*s* so that the slots 12*s*,14*s* allow reciprocal sliding movement of the rod fastener RF and second end 50*b* of the spring rod along the spring rod axis RX but prevent movement of the rod fastener RF and second end 50*b* of the spring rod in a direction transverse to the spring rod axis RX, i.e., the presence of the rod fastener RF in the slots 12*s*,14*s* ensures that movement of the spring rod 50 is restricted to reciprocal sliding movement R along the longitudinal spring rod axis RX. The spring rod 50 moves to and between an extended position (FIG. 2B) in which its first (outer) end 50*a* is moved away from the transverse wall 16, and a retracted position (FIG. 2C) in which its first (outer) end is located closer to the transverse wall 16 as compared to the extended position. As such, the first/outer end 50*a* of the spring rod 50 is spaced farther from the transverse wall 16 in the extended position as compared to the retracted position. The extended position of the spring rod 50 corresponds to the appliance lid L being opened, and the retracted position of the spring rod 50 corresponds to the appliance lid L being closed. The side wall slots 12*s*,14*s* limit movement of the rod fastener RF and thus limit movement of the spring rod 50 as it moves to and between its extended and retracted positions.

The first or outer end 50*a* of the spring rod 50 include a spring stop 50*s* that comprises an enlarged head or other portion of the spring rod 50, and/or that comprises a separate member such as a cross-pin or other structure secured to or provided as part of the spring rod first end 50*a*. The biasing spring system 42 further comprises a biasing spring G operably engaged with the spring rod 50 and biasing the spring rod toward its extended (lid-opened) position. In the illustrated example, the biasing spring G comprises a helical coil spring coaxially positioned on the spring rod 50 so that the spring rod 50 extends through the open center of the coil spring. The coil spring G is captured between the spring stop 50*s* at the first (outer) end of the spring rod 50 and the transverse wall 16 of the base 10, and the spring G is thus configured as a compression spring in which resilient lengthening of the spring G establishes a biasing force BF that is exerted on the spring rod 50 and that continuously urges the first end 50*a* of the spring rod outwardly away from the transverse wall 16 and, thus, continuously urges the spring rod 50 toward its extended position. Movement of the spring rod 50 toward and into its retracted position against this biasing force BF resiliently shortens and compresses the spring G between the spring stop 50*s* and the transverse wall 16. A washer or other spacer can be positioned between the spring stop 50*s* and a first end G1 of the spring G and/or between the transverse wall 16 and the second end G2 of the spring G. In an alternative embodiment, the connector linkage 44 can be arranged with one or more connector links 46 in a manner such that the spring G is configured as a tension spring that elongates during closing of the appliance lid L wherein the biasing force BF is exerted on the spring rod 50 by resilient shortening of the spring G.

As noted, the cam arm 30 is operatively engaged with the spring rod 50. In use, the biasing spring system 42 continuously biases the spring rod 50 toward its extended position, which results in the cam follower 48 being continuously urged into contact with the cam profile edge 32*e* of the cam arm 30. Manual pivoting movement of the appliance lid L about the pivot axis X in the opening direction OD between its closed position (FIG. 2C) and its fully opened position (FIG. 2B) through the intermediate position (FIG. 2A) rotates the cam arm 30 about the pivot axis X in the opening direction OD and alters the contact location at which the cam follower 48 contacts the cam profile edge 32*e* which, in turn alters the rotational or angular position of the connecting link 46 on the arc A. The angular position of the connecting link 46 on the arc A controls the position of the second end 46*b* of the connecting link which, in turn, controls the position of the second (inner) end 50*b* of the spring rod 50 so that the spring rod is moved toward and away from its extended and retracted positions based upon the angular position of the appliance lid L and cam arm 30 about the pivot axis X. In other words, the position at which the cam follower 48 contacts the cam profile edge 32*e* controls the position of the follower 48 relative to the base 10 which controls the position of the spring rod 50 between its extended and retracted positions. As such, the biasing force BF of the spring G acts: (i) to assist in movement of the lid L from its closed position toward its opened position and to provide a counterbalance mechanism that counteracts the weight of the lid L; and (ii) to hold the lid L in its intermediate position (FIG. 2A) when the cam follower 48 is engaged with the second (detent) portion e2 of the cam profile edge 32*e*.

Between the closed position of the lid L (FIG. 2C) and the intermediate position (FIG. 2A), the cam follower 48 is in contact with the smoothly curved third portion e3 of the cam profile edge 32*e* such that the biasing force BF aids in moving the lid L in the opening direction OD and slows or counteracts movement of the lid L in the closing direction CD.

In the intermediate position of the appliance lid L (FIG. 2A), the cam follower 48 is in contact with the second (detent) portion e2 of the cam profile edge 32*e*. Location of the cam follower 48 in the recess of the detent portion e2 in combination with the biasing force BF exerted by the spring G inhibits movement of the appliance lid L in either the opening direction OD or closing direction CD such that the lid L is self-supporting in the intermediate position and need not be manually restrained in the intermediate position by a user.

Manual pivoting movement of the appliance lid L about the pivot axis X in the closing direction CD between its opened position (FIG. 2B) and its closed position (FIG. 2C) through the intermediate position (FIG. 2A) rotates the cam arm 30 about the pivot axis X in the closing direction CD and alters the contact location at which the cam follower 48 contacts the cam profile edge 32*e* which, in turn alters the rotational or angular position of the connecting link 46 on the arc A. In particular, manual pivoting movement of the appliance lid L about the pivot axis X in the closing direction CD results in sliding movement of the spring rod 50 from its extended position toward and into its retracted position against the biasing force BF of the spring G.

In the fully opened position of the appliance lid L (FIG. 2B), the cam follower 48 is in contact with the first portion e1 of the cam profile edge 32*e*, and the follower 48 is offset from the pivot fastener F1 to establish a lever or moment arm. The flat structure of the first portion e1 in combination with the offset between the follower 48 and pivot fastener F1 increases the effect of the biasing force BF on the cam arm 30 in the lid-opening direction OD so that the appliance lid L is positively restrained in the fully opened position and is resistant to inadvertent movement in the closing direction CD due to incidental contact of the lid L by a user.

FIGS. 3, 3A, 3B, and 3C correspond respectively to FIGS. 2, 2A, 2B, and 2C, but show the hinge assembly H2 which is an alternative embodiment of the hinge assembly H1. The hinge assembly H2 is identical to the hinge assembly H1 except as otherwise shown and/or described herein, and like reference characters are used in the drawings to identify components corresponding to like components of the hinge assembly H1 without further explanation below. More particularly, the hinge assembly H2 is identical to the hinge assembly H1 except that it further comprises a damper system DS arranged and configured to damp movement of the appliance lid L as the appliance lid moves in the closing direction CD from an opened position toward and into the closed position to prevent or at least inhibit forceful closing or "slamming" of the lid L against the appliance body B when the lid L moves to its closed position.

In general, the damper system DS comprises a damper D connected to the base 10 and located to be engaged and activated by the cam arm 30, connector linkage 44, connector link 46, the spring rod 50, and/or any other part of the cam arm control system 40, or another structure connected to or moved by any of the same, during movement of the appliance lid L in the closing direction CD to dampen and slow movement of the cam arm 30 and lid L in the closing direction. In the non-limiting example of the illustrated embodiment, the damper system DS comprises a damper housing DH that is connected to the base 10. The damper housing DH comprises a molded polymeric or other structure that is located in the space 18 between the side walls 12,14 and that is fixedly secured to the base 10 using a damper fastener such as a rivet or the like DR that extends through both side walls 12,14 and through the damper housing DH. The base 10 can include one or more tabs, grooves, flanges or other structures for engaging the damper housing DH for assisting with locating and securing the damper housing DH in its operative position.

In this embodiment, the damper D is operably engaged with and supported by the damper housing DH. The damper housing DH includes a damper support bore DB, and the damper D is operably located in the damper support bore DB. In the illustrated example, the damper support bore DB is coaxially aligned with the longitudinal axis RX of the spring rod 50, but it can be offset from and parallel to the longitudinal axis RX or otherwise oriented.

Figure 3:
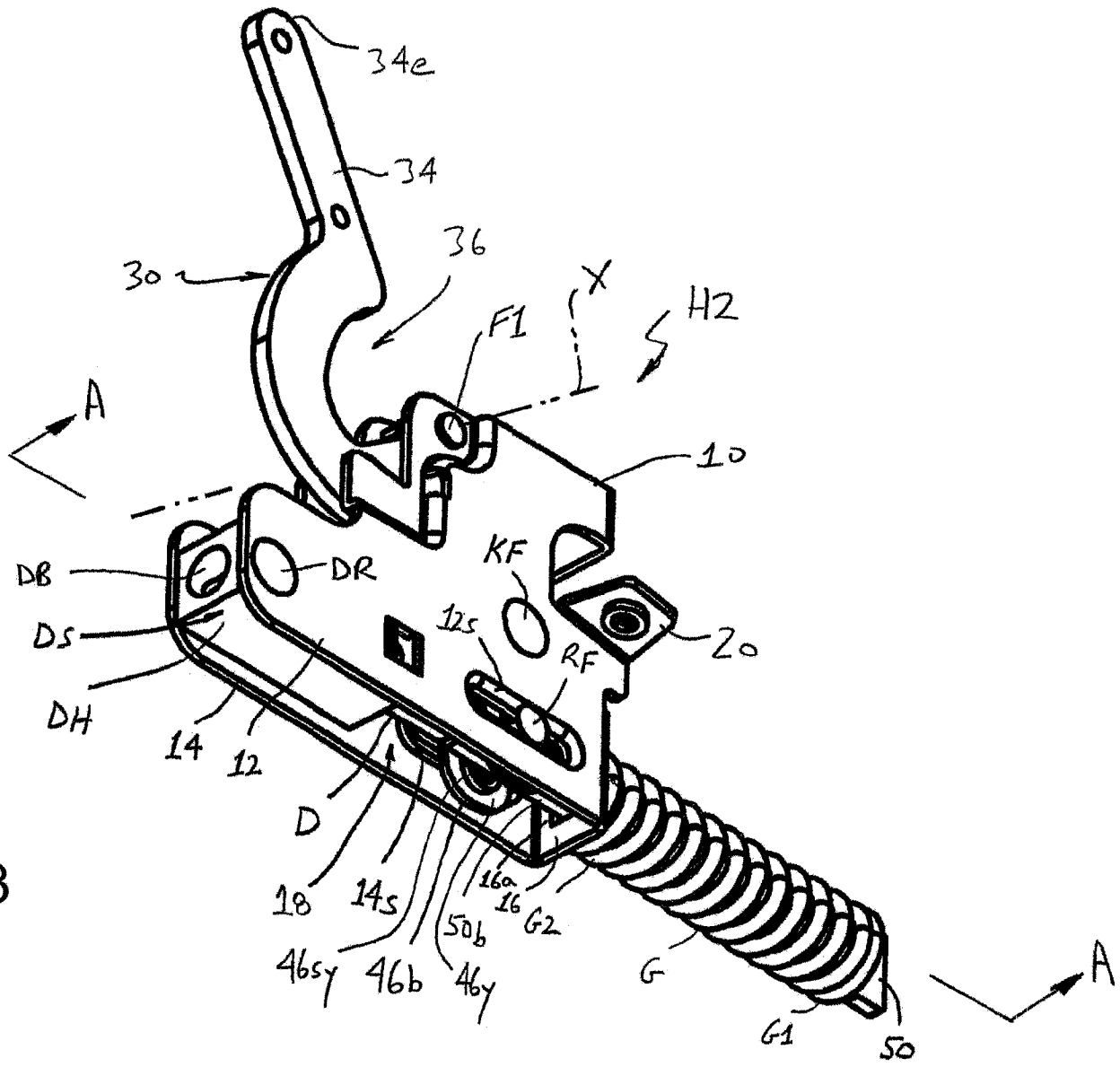
FIGS. 3, 3A, 3B, and 3C correspond respectively to FIGS. 2, 2A, 2B, and 2C, but show a hinge assembly according to a second embodiment of the present development.
Figure 3A:
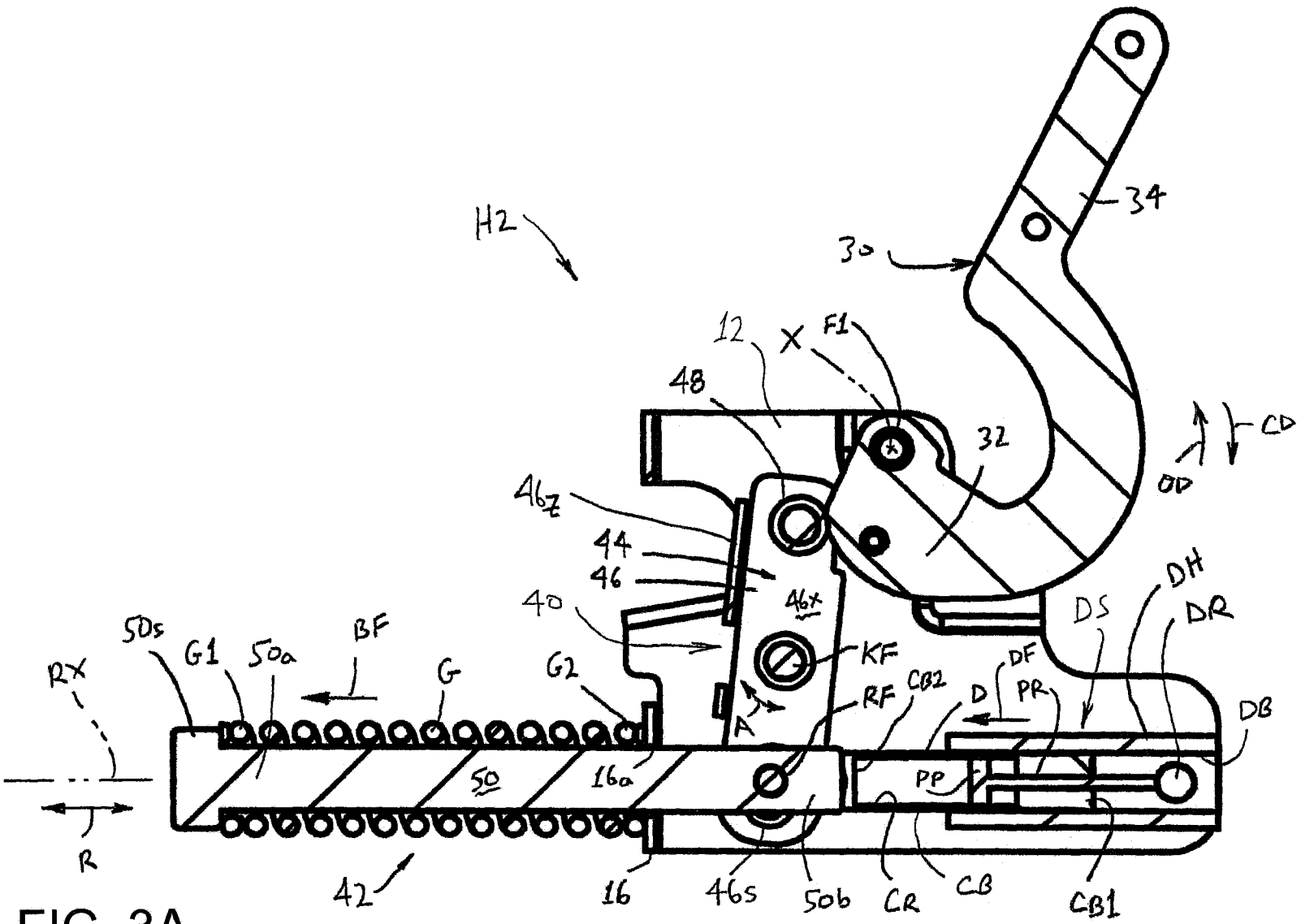
Figure 3B:
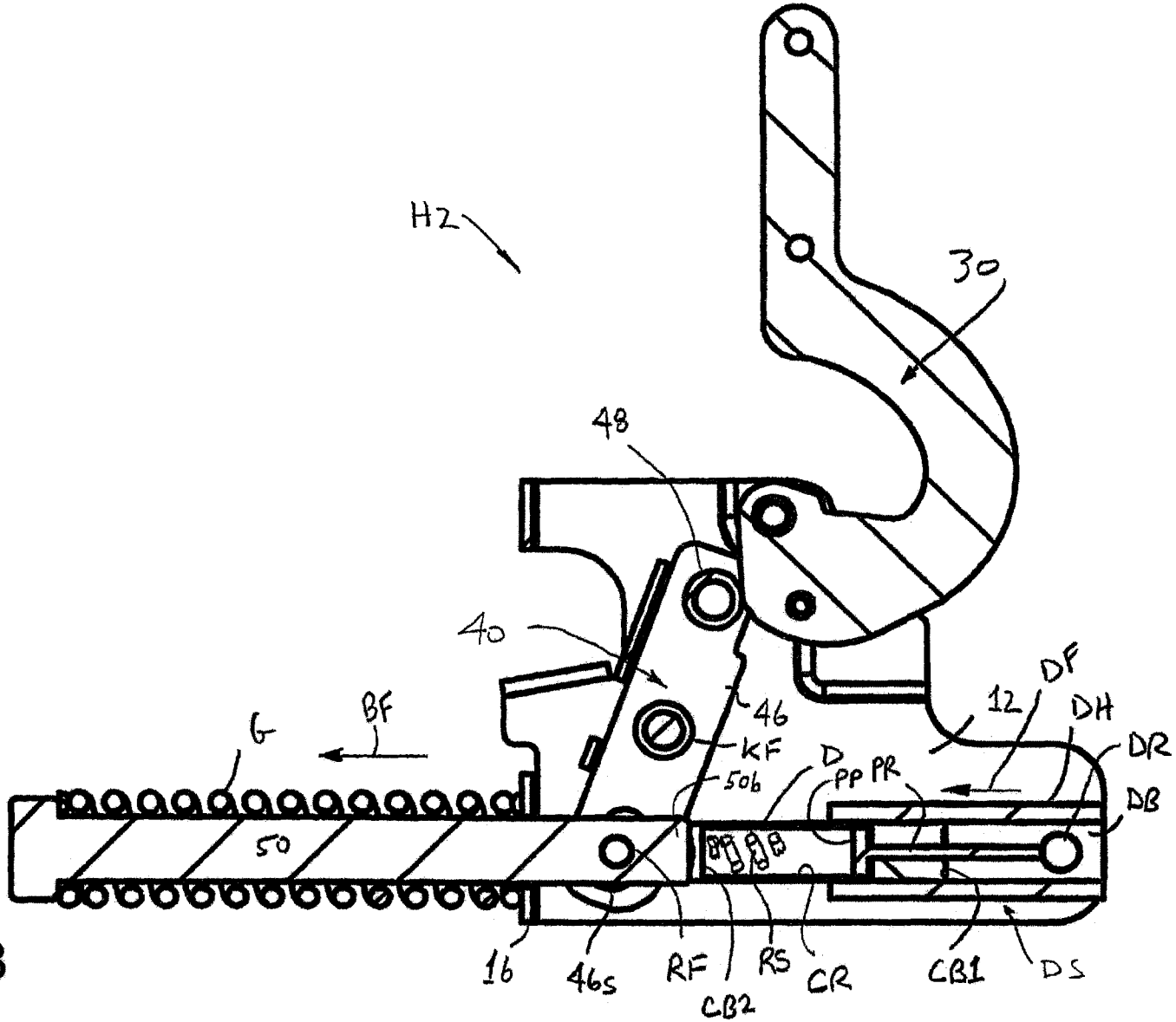
Figure 3C:
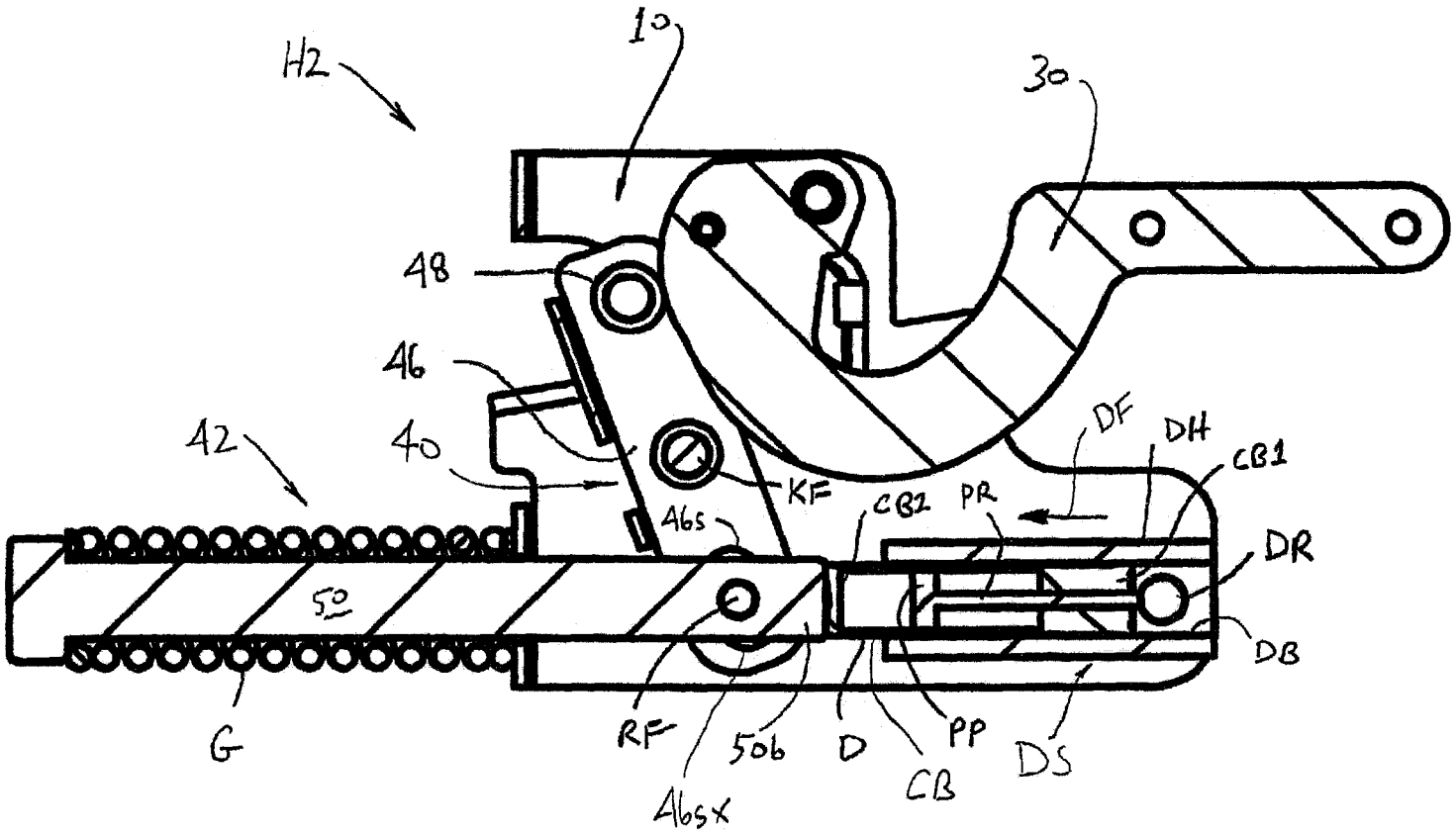

The damper D, itself, comprises a damper cylinder or damper cylinder body CB that includes a cylinder bore CR in which a piston PP is slidably supported for reciprocal sliding movement between an extended piston position (FIG. 3B) and a retracted piston position (FIG. 3C). FIG. 3A shows a partially retracted position of the piston PP between the extended and retracted positions. A piston rod PR includes an inner end connected to the piston PP and the piston rod PR extends outwardly from the cylinder bore CR at a first end CB1 of the cylinder body CB to an outer end. The cylinder body CB also includes a closed second end CB2 located opposite the first end CB1. When the piston PP is extended the piston rod PR projects outwardly from the body first end CB1 a greater extent as compared to when the piston PP is retracted. When the piston PP is retracted, it is moved away from the body first end CB1 and toward the body second end CB2 so that the piston rod PR is correspondingly retracted into the cylinder bore CR and projects outwardly from the body first end CB1 a lesser extent as compared to when the piston PP is in its extended position. The extended and retracted positions of the piston PP correspond respectively to extended and retracted positions or states of the damper D.

In the illustrated example, the cylinder body CB is located in the damper support bore DB of the damper housing DH, and the cylinder body CB is reciprocally slidable or movable in the damper support bore DB. In the present embodiment, the cylinder body slidably reciprocates in the damper support bore DB on an axis coincident with the spring rod axis RX. As shown herein, the damper D is arranged with its piston rod PR oriented away from the spring rod 50 and toward the damper fastener DR and with the second end CB2 of the cylinder body CB projecting outwardly from the damper support bore DB toward the spring rod 50. Preferably, the outer end of the piston rod PR is abutted with the damper fastener DR and the second end CB2 of the cylinder body is abutted with the second (inner) end 50*b* of the spring rod 50 for all operative positions of the cam arm 30, but the spring rod 50 can alternatively separate from the second end CB2 of the cylinder body and the piston rod PR can alternatively separate from the damper fastener without departing from the scope and intent of the present development. The orientation of the damper D in the damper support bore DB can optionally be reversed so that the piston rod PR projects toward the spring rod 50 and so that the second end CB2 of the cylinder body is located in the damper support bore DB and oriented toward the damper fastener DR, in which case the outer end of the piston rod PR is preferably abutted with the second end 50*b* of the spring rod 50 and the second end CB2 of the cylinder body is preferably abutted with the damper fastener DR for all operative positions of the cam arm 30. In the illustrated embodiment, the piston PP moves between its extended and retracted positions along a damper axis that is coincident with the spring rod axis RX.

A gas or liquid damping fluid and/or a mechanical damping spring is contained in the cylinder bore CR and acts on the piston PP to damp its movement from the extended position toward the retracted position in response to inward and outward movement of the cylinder body CB in the damper support bore DB relative to the piston PP. Preferably, the piston PP is configured such that the damping fluid damps movement of the piston PP to a greater extent when the piston is moving from its extended position toward its retracted position as compared to the opposite direction of movement of the piston to facilitate a faster return or "reset" of the piston PP from its retracted position to its extended position. The illustrated damper P includes a mechanical return spring such as a coil spring RS within the bore CR (shown partially only in FIG. 3B) to return the piston PP from its retracted position to its extended position when the damper D is not under load, i.e., to urge the cylinder body CB outwardly toward the spring rod 50. The return spring RS is alternatively externally located relative to the cylinder bore CR and coaxially positioned about the piston rod PR between the first end CB1 of the cylinder body and a cap or spring stop connected to or formed as part of the outer end of the piston rod PR to bias the piston PP to its extended position relative to the cylinder body CB.

The hinge assembly H2 operates in the same manner as the hinge assembly H1, except that when the cam arm 30 is pivoted in the closing direction CD during movement of the appliance lid L from an opened position toward the closed position, the second end 50*b* of the spring rod 50 engages and activates the damper D by urging the cylinder body CB inward relative to the piston and causing the piston PP to move toward its retracted position and the damper D to move toward its retracted condition when the spring rod 50 moves inwardly from its extended position toward its retracted position, and the damper D thus exerts an opposite damping force DF against the spring rod 50 that slows and damps movement of the spring rod 50 from its extended position toward its retracted position. As such, the damping force DF slows movement of the appliance lid L in the closing direction CD to reduce the force with which the lid L contacts the body B when the lid reaches its closed position. When the lid L is manually opened by movement in the opening direction OD, the spring rod 50 moves away from the damper D so that the damper can reset (return to its configuration in which the piston PP and piston rod PR are extended) when the return spring RS moves the cylinder body CB outwardly away from the piston PP to place the piston in its extended position and to place the damper D in its extended condition.

In an alternative embodiment, the damper D is connected to the base 10 such that it is activated by the connector link 46 or other part of the connector linkage 44. For example, the damper D is alternatively connected to the base 10 in a location where the first end 46*a* or the second end 46*b* of the connector link 44 contacts and activates the damper D during movement of the appliance lid L and cam arm 30 in the lid closing direction CD. In another alternative embodiment, the damper D is connected to the base 10 in a location where the damper D is contacted and activated by direct contact with the cam arm 30 or by contact with a movable structure connected to the base 10 that is, itself, moved by the cam arm 30 when the lid L and cam arm 30 are moved in the lid closing direction CD. Those of ordinary skill in the art will recognize that the damper D can be connected to the base 10 at any desired location where it is contacted and activated by the cam arm 30, cam arm control system 40, or where it is contacted and activated by a member that is connected to and/or moved by the cam arm 30 or by any part of the cam arm control system 40.

Figure 4:
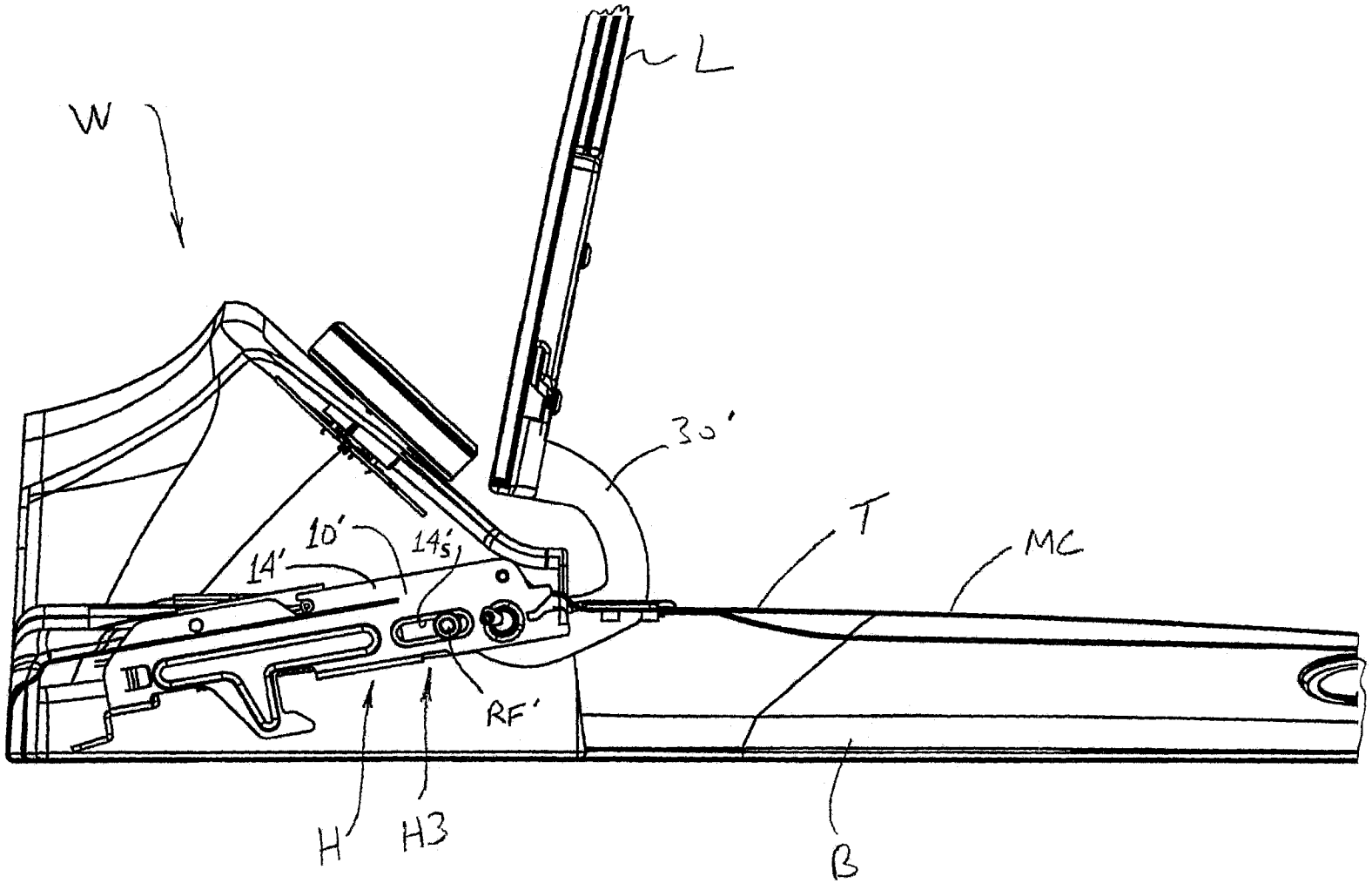
FIG. 4 is a partial side view of a washer or other appliance and shows a hinge assembly formed in accordance with a third embodiment of the present development used to secure the lid operatively to the body.
Figure 5:
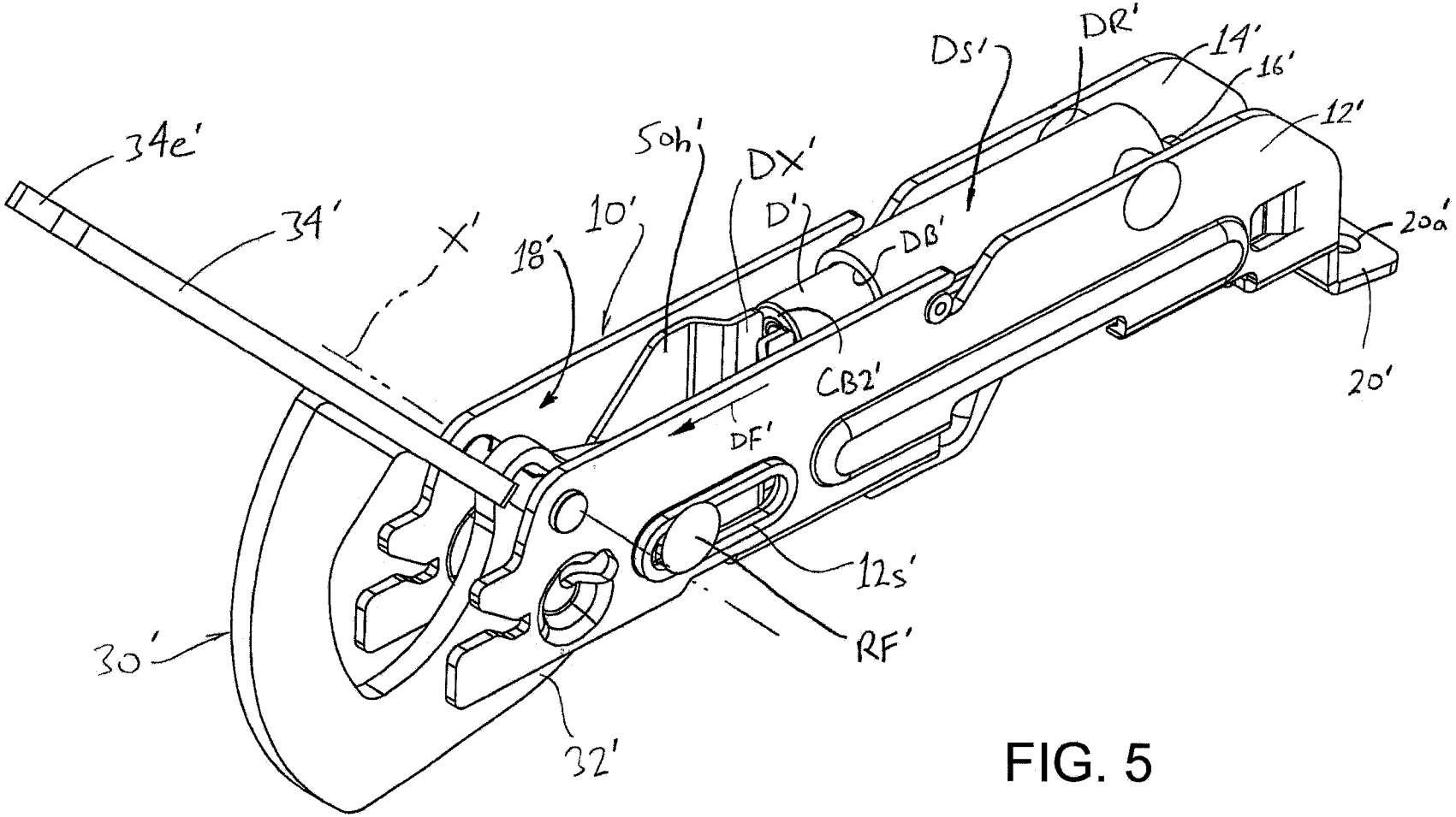
FIG. 5 provides an isometric view of a hinge assembly according to the third embodiment of the present development, with the hinge assembly arranged in an intermediate opened position corresponding to the intermediate opened position of the appliance lid.
Figure 5A:
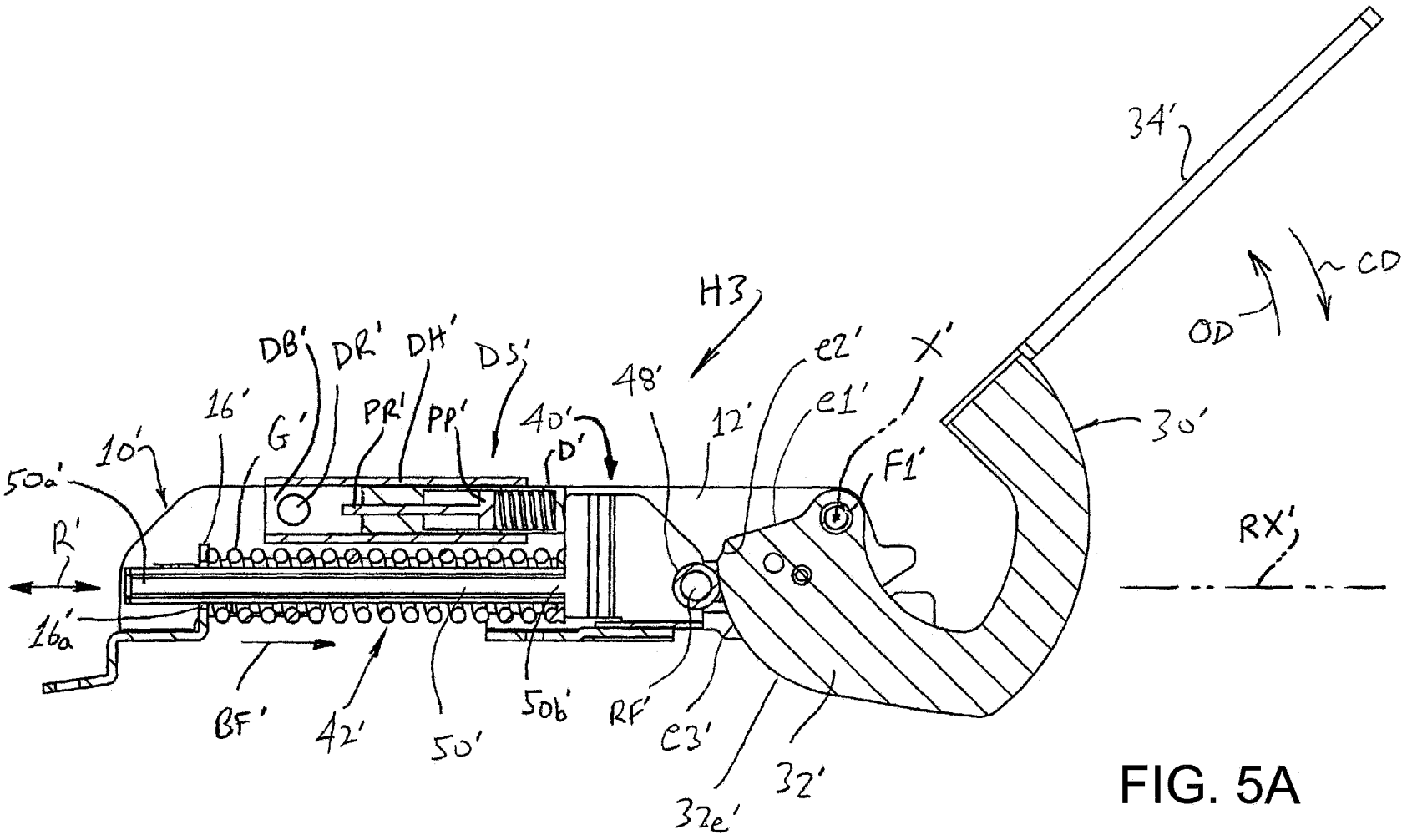
FIGS. 5A, 5B, and 5C are section views of the hinge assembly of FIG. 5 that correspond to the view of FIGS. 3A, 3B, and 3C.
Figure 5B:
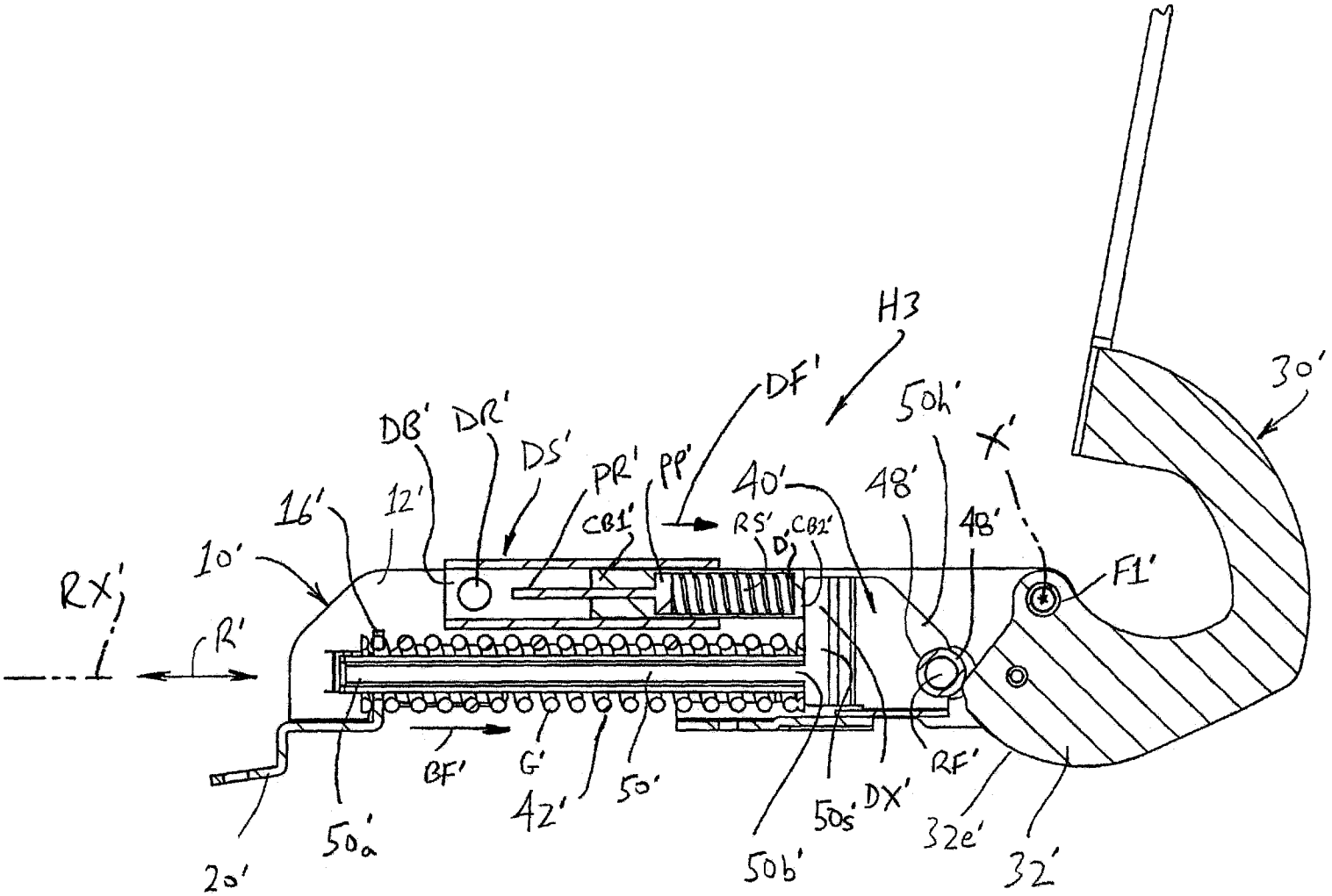
Figure 5C:
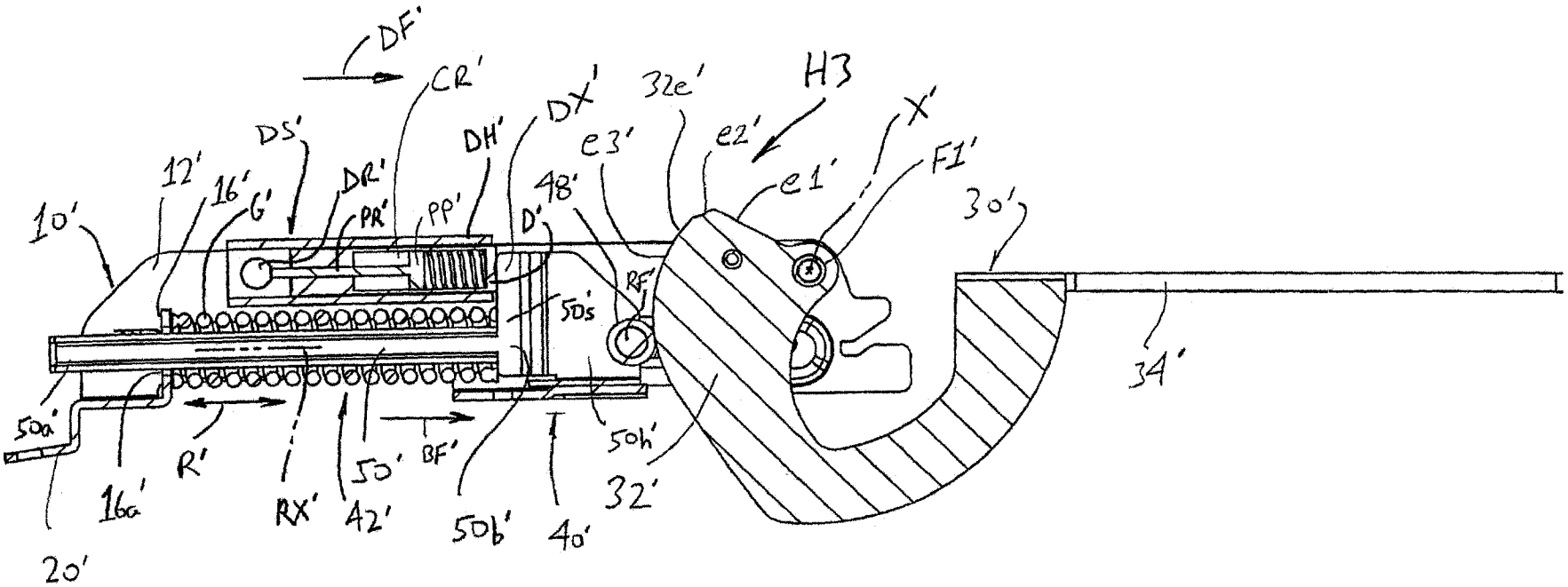

FIGS. 4-5C discloses another alternative embodiment of a hinge assembly formed according to the present development. In particular, FIG. 4 shows that at least one of the hinges H of the appliance W comprises a hinge assembly H3 formed according to a third embodiment of the present development. The hinge assembly H3 is particularly well-suited for use on an appliance W that has a limited mounting envelope in which the hinge assembly H3 must be installed. First and second hinge assemblies H3 can be used to operatively secure the lid L to the body B, or one hinge assembly H3 can be used with another hinge assembly such as the hinge assembly H1 or H2 or a conventional hinge assembly. FIGS. 5, 5A, 5B, and 5C correspond respectively to FIGS. 3, 3A, 3B, and 3C, but show the hinge assembly H3 which is an alternative embodiment of the hinge assembly H2. Except as otherwise shown and or described herein, the hinge assembly H3 is identical to the hinge assembly H2, and like or corresponding components are identified with like reference characters that include a primed (') designation, and the detailed description of such components is not necessary repeated fully below.

The hinge assembly H3 comprises a base 10' adapted to be connected to the appliance body B. The base 10' is structured generally as described above for the base 10 and comprises parallel, spaced-apart first and second side walls 12',14' and an end wall or transverse wall 16' provided by a tab or other wall structure located between and oriented transversely relative to the first and second side walls 12',14'. An open channel or space 18 is defined between the side walls 12',14' and end wall 16'. The base 10' comprises one or more mounting tabs 20'. As noted above for the hinge assemblies H1,H2, the end wall 16' need not be located at the end of the base 10' and can be located at any axial location between the side walls 12',14'.

The hinge assembly H3 comprises a cam arm 30' that is pivotally connected to the base 10' using a main pivot fastener F1' as described above such that the cam arm 30' rotates about the main pivot fastener F1' and about the pivot axis X'. An inner end of the cam arm 30' is located in the space 18' between the first and second side walls 12',14' of the base 10'. The cam arm 30' comprises an inner cam portion 32' and an outer mounting portion 34' and otherwise corresponds to the structure of the cam arm 30 and is not described further here. The cam portion 32' is also structured as described for the cam portion 32 of the hinge assembly H2.

The hinge assembly H3 further comprises a cam arm control subassembly or system 40' connected to the base 10 for exerting a biasing force on and controlling movement of the cam arm 30' when the cam arm 30' is rotated or pivoted about the main pivot fastener F1' during movement of the appliance lid L to and between its closed and opened positions. The cam arm 30' is operatively engaged with the spring rod 50' by way of the cam arm control system 40'. In particular, the cam arm control system 40' comprises a biasing spring system 42' as generally described above for the hinge assembly H2, but the hinge assembly omits the connector linkage 44 of the hinge assembly H2. Instead of using a connector linkage 44 to operatively engage the biasing spring system 42' with the cam portion 32' of the cam arm 30', the biasing spring system 42' is directly engaged with the cam portion 32' in the hinge assembly H3.

In particular, the biasing spring system 42' comprises a spring rod 50' including a first or outer end 50*a'* and an opposite second or inner end 50*b'*. The spring rod 50' is slidably connected to the base 10'. In the embodiment of FIGS. 5-5C, the spring rod 50' is slidably located in an aperture 16*a'* defined in the transverse wall 16' of the base 10' such that the first end 50*a'* of the spring rod is located on an external side of the transverse wall 16', external to the space 18' defined between the first and second side walls 12',14' and the transverse wall 16', and the second end 50*b'* of the spring rod is located on an internal side of the transverse wall 16', in the space 18 defined between the first and second side walls 12',14' and the transverse wall 16). A cam follower 48', such as the illustrated roller or a non-rotatable bushing or slide member or other structure, is connected to or otherwise located on the second (inner) end 50*b'* of the spring rod 50' and is in contact with the cam profile edge 32*e'* of the cam arm 30' such that the follower 48' is operably engaged with the cam portion 32' of the cam arm 30'. As such, the cam arm 30' is operatively engaged with the cam arm control system 40', including the spring rod 50' thereof. In the illustrated embodiment, a rod fastener RF' such a rivet, pin, or other fastener is used to connect the follower 48' to the second end 50*b'* of the spring rod 50'.

The spring rod 50' is preferably restricted to reciprocal linear sliding movement along its longitudinal spring rod axis RX' relative to the base 10' as indicated by the arrow R'. In the illustrated embodiment, the opposite first and second side walls 12',14' of the base include respective elongated slots 12*s'*,14*s'* (see also FIG. 4) that are aligned or registered with each other and that are elongated along respective axes that lies parallel to the spring rod axis RX. In this embodiment, the opposite ends of the rod fastener RF extend through and are located in the respective slots 12*s'*,14*s'* so that the slots 12*s'*,14*s'* allow reciprocal sliding movement of the rod fastener RF' and second end 50*b'* of the spring rod along the spring rod axis RX' but prevent movement of the rod fastener RF and second end 50*b'* of the spring rod in a direction transverse to the spring rod axis RX'.

The spring rod 50' moves to and between an extended position (FIG. 5B) in which its second (inner) end 50*b'* is moved away from the transverse wall 16' toward the cam arm 30', and a retracted position (FIG. 5C) in which its second (inner) end 50*b'* is moved away from the cam arm 30' so as to be located closer to the transverse wall 16' as compared to the extended position. As such, the first/outer end 50*a'* of the spring rod 50' is spaced farther from the transverse wall 16' in the retracted position as compared to the extended position. The extended position of the spring rod 50' corresponds to the appliance lid L being opened, and the retracted position of the spring rod 50' corresponds to the appliance lid L' being closed. The side wall slots 12*s'*,14*s'* limit the magnitude and direction of movement of the rod fastener RF' and thus correspondingly limit movement of the spring rod 50' as it moves in a reciprocal manner along the spring rod axis RX to and between its extended and retracted positions.

The second or inner end 50*b'* of the spring rod 50 includes a spring stop 50*s'* that comprises an enlarged head 50*h'* or other portion of the spring rod 50, and/or that comprises a separate member such as a cross-pin or other structure secured to or provided as part of the spring rod second end 50*b'*. The biasing spring system 42' further comprises a biasing spring G' operably engaged with the spring rod 50' and biasing the spring rod toward its extended (lid-opened) position. In the illustrated example, the biasing spring G' comprises a helical coil spring coaxially positioned about the spring rod 50' so that the spring rod extends through the open center of the coil spring. The coil spring G' is captured between the spring stop 50*s'* at the second (inner) end of the spring rod 50' and the transverse wall 16' of the base 10', and the spring G' is thus configured as a compression spring in which resilient lengthening of the spring G' establishes a biasing force BF' that is exerted on the spring rod 50' and that continuously urges the second end 50*b'* of the spring rod away from the transverse wall 16 toward the cam arm and, thus, continuously urges the spring rod 50' toward its extended position. Movement of the spring rod 50' toward and into its retracted position against this biasing force BE resiliently shortens and compresses the spring G' between the spring stop 50*s'* and the transverse wall 16.

In use, the biasing spring system 42' continuously biases the spring rod 50' toward its extended position, which results in the cam follower 48' being continuously urged into contact with the cam profile edge 32*e'* of the cam arm 30'. Manual pivoting movement of the appliance lid L about the pivot axis X' in the opening direction OD between its closed position (FIG. 5C) and its fully opened position (FIG. 5B) through the intermediate position (FIG. 5A) rotates the cam arm 30' about the pivot axis X' in the opening direction OD and alters the contact location at which the cam follower 48' contacts the cam profile edge 32*e'* which, in turn, alters and controls the position of the second (inner) end 50*b'* of the spring rod 50' on the spring rod axis RX' so that the spring rod 50' is moved toward and away from its extended and retracted positions based upon the angular position of the appliance lid L and cam arm 30' about the pivot axis X'. In other words, the position of the cam follower 48' on the cam profile edge 32*e'* controls the position of the follower 48' relative to the base 10' which controls the position of the spring rod 50' between its extended and retracted positions. As such, the biasing force BF' of the spring G' acts: (i) to assist in movement of the lid L from its closed position toward its opened position and to provide a counterbalance mechanism that counteracts the weight of the lid L; and (ii) to hold the lid L in its intermediate position (FIG. 5A) when the cam follower 48' is engaged with the second (detent) portion e2' of the cam profile edge 32*e'*.

Between the closed position of the lid L (FIG. 5C) and the intermediate position (FIG. 5A), the cam follower 48' is in contact with the smoothly curved third portion e3' of the cam profile edge 32*e'* such that the biasing force BF' aids in moving the lid L in the opening direction OD and slows or counteracts movement of the lid L in the closing direction CD.

In the intermediate position of the appliance lid L (FIG. 5A), the cam follower 48' is in contact with the second (detent) portion e2' of the cam profile edge 32*e'*. Location of the cam follower 48' in the recess of the detent portion e2' in combination with the biasing force BF' exerted by the spring inhibits movement of the appliance lid L in either the opening direction OD or closing direction CD such that the lid L is self-supporting in the intermediate position and need not be manually restrained in the intermediate position by a user.

In the fully opened position of the appliance lid L (FIG. 5B), the cam follower 48' is in contact with the first portion e1' of the cam profile edge 32*e'*, and the follower 48' is linearly offset from the pivot fastener F1' to establish a lever or moment arm. The flat structure of the first portion e1' in combination with the offset between the follower 48' and pivot fastener F1' increases the effect of the biasing force BF on the cam arm 30 in the lid-opening direction OD so that the appliance lid L is positively restrained in the fully opened position and is resistant to inadvertent movement in the closing direction CD due to incidental contact of the lid L by a user.

Like the hinge assembly H2, the hinge assembly H3 comprises a damper system DS' arranged and configured to damp movement of the appliance lid L as the appliance lid moves in the closing direction CD from an opened position toward and into the closed position to prevent or at least inhibit forceful closing or "slamming" of the lid L against the appliance body B when the lid L moves to its closed position.

In general, the damper system DS' comprises a damper D' connected to the base 10' and located to be engaged and activated by the cam arm 30', the spring rod 50', and/or any other part of the cam arm control system 40', or another structure connected to or moved by any of the same, during movement of the appliance lid L in the closing direction CD to dampen and slow movement of the cam arm 30' and lid L in the closing direction. In the non-limiting example of the illustrated embodiment, the damper system DS' comprises a damper housing DH' that is connected to the base 10'. The damper housing DH' comprises a molded polymeric or other structure that is located in the space 18' between the side walls 12',14' adjacent the spring rod 50' and that is fixedly secured to the base 10' using a damper fastener such as a rivet or the like DR' that extends through both side walls 12',14' and through the damper housing DH'. The base 10' can include one or more tabs, grooves, flanges, slots or other structures for engaging the damper housing DH' for assisting with locating and securing the damper housing DH' in its operative position.

In this embodiment, the damper D' is operably engaged with and supported by the damper housing DH'. The damper housing DH' includes a damper support bore DB', and the damper D' is operably located in the damper support bore DB'. In the illustrated example, the damper support bore DB' extends along a bore axis that is offset from and that lies parallel to the longitudinal spring rod axis RX', but it can be coaxial with or otherwise oriented relative to the spring rod axis RX'.

The damper D', is structured and functions as described above for the damper D. As shown herein, the damper D' is arranged with its piston rod PR' oriented toward the damper fastener DR', but this arrangement can be reversed so that the second end CB2' of the cylinder body is located in the damper support bore DB' and oriented toward the damper fastener DR'. In the illustrated embodiment, the piston PP' of the damper D' moves between its extended and retracted piston positions in the cylinder bore CR' along a damper axis that is offset from but parallel to the spring rod axis RX'.

The hinge assembly H3 comprises a damper actuator DX' that is connected to or otherwise operably engaged with and/or provided as a part of the second (inner) end 50*b'* of the spring rod 50' so that the damper actuator moves with the spring rod when the spring rod 50' reciprocates along the spring rod axis RX between its extended and retracted positions. In the illustrated embodiment H3, the spring stop 50*s'* comprises an enlarged head 50*h'* connected to and/or provided on the second end 50*b'* of the spring rod, and the damper actuator DX' is provided by and comprises a portion of the enlarged head 50*h'* of the spring stop 50*s'*. Thus, when the spring rod 50' reciprocates, the damper actuator reciprocates therewith and actuates the damper D' as described below. As shown herein, the enlarged head 50*h'* comprises a bifurcated or yoke structure that supports the follower 48'.

In particular, when the cam arm 30' is pivoted in the closing direction CD during movement of the appliance lid L from an opened position toward the closed position, the damper actuator DX' located on the second end 50*b'* of the spring rod engages and activates the damper D' by urging the cylinder body CB' inward relative to the piston PP' and causing the piston PP' to move toward its retracted position and the damper D' to move toward its retracted condition when the spring rod 50 moves from its extended position toward its retracted position. In this case, the damper D' thus an opposite damping force DF' against the damper actuator DX portion of the spring rod that slows and damps movement of the spring rod 50' from its extended position toward its retracted position. As such, the damping force DF' slows movement of the appliance lid L in the closing direction CD to reduce the force with which the lid L contacts the body B when the lid reaches its closed position. When the lid L is manually opened by movement in the opening direction OD, the damper actuator DX' of the spring rod 50' moves away from the damper D' so that the damper can reset (return to its configuration in which the piston PP' and piston rod PR' are extended) when the damper return spring RS' moves the cylinder body CB' outwardly away from the piston PP' to place the piston in its extended position and to place the damper D' in its extended condition.

The development has been described with reference to preferred embodiments. Modifications and alterations will occur to those of ordinary skill in the art to which the invention pertains, and it is intended that the claims be construed as broadly as possible while maintaining their validity in order to encompass all such modifications and alterations.

The invention claimed is:

1. An appliance lid hinge assembly comprising:

a base;

a cam arm pivotally connected to the base and adapted to be connected to an associate appliance lid;

a cam arm control system comprising a spring rod engaged with the base and adapted to move relative to the base in a sliding reciprocal manner along a spring rod axis;

a spring that exerts a biasing force on the spring rod that urges the spring rod toward an extended position, wherein said spring rod is movable against the biasing force from the extended position toward a retracted position;

said cam arm operatively engaged with the spring rod through a cam follower such that: (i) pivoting movement of the cam arm in an opening direction corresponds with movement of the spring rod from the retracted position toward the extended position; and, (ii) pivoting movement of the cam arm in a closing direction opposite the opening direction corresponds with movement of the spring rod from the extended position toward the retracted position;

said cam arm comprising: (i) a cam portion located adjacent the base and including a cam profile edge; and, (ii) an outer mounting portion that projects outwardly away from the base;

said cam follower connected to an inner end of the spring rod and engaged with said cam profile edge such that pivoting movement of the cam arm in the opening direction and in the closing direction alters a contact location at which the cam follower contacts the cam profile edge to control movement of the spring rod between the extended and retracted positions;

wherein a rod fastener connects said follower to said inner end of said spring rod and said rod fastener is slidably engaged with said base, said base comprising opposite spaced apart first and second side walls that comprise respective first and second elongated slots that are registered with each other, wherein said rod fastener is slidably engaged with both said first and second elongated slots;

a damper connected to said base and adapted to be engaged by and exert a damping force on said cam arm control system when said cam arm moves in said closing direction.

2. The appliance hinge assembly as set forth in claim 1, wherein said damper is engaged by said spring rod of said cam arm control system when said spring rod moves toward its retracted position.

3. The appliance hinge assembly as set forth in claim 2, wherein said damper comprises a piston that moves between an extended piston position and a retracted piston position along an axis that is offset from and parallel to the spring rod axis.

4. The appliance hinge assembly as set forth in claim 3, wherein said inner end of said spring rod comprises an enlarged head comprising a damper actuator for engaging said damper, said enlarged head comprising a bifurcated yoke structure to which said follower is connected.

5. An appliance lid hinge assembly comprising:

a base;

a cam arm pivotally connected to the base and adapted to be connected to an associate appliance lid;

a cam arm control system comprising a spring rod engaged with the base and adapted to move relative to the base in a sliding reciprocal manner along a spring rod axis;

a spring that exerts a biasing force on the spring rod that urges the spring rod toward an extended position, wherein said spring rod is movable against the biasing force from the extended position toward a retracted position;

said cam arm operatively engaged with the spring rod through a cam follower such that: (i) pivoting movement of the cam arm in an opening direction corresponds with movement of the spring rod from the retracted position toward the extended position; and, (ii) pivoting movement of the cam arm in a closing direction opposite the opening direction corresponds with movement of the spring rod from the extended position toward the retracted position;

said cam arm comprising: (i) a cam portion located adjacent the base and including a cam profile edge; and, (ii) an outer mounting portion that projects outwardly away from the base;

wherein said cam follower is engaged with said cam profile edge such that pivoting movement of the cam arm in the opening direction and in the closing direction alters a contact location at which the cam follower contacts the cam profile edge to control movement of the spring rod between the extended and retracted positions;

said cam arm control system further comprising a connector link pivotally connected to the base, wherein said cam follower is connected to a first end of the connector link and wherein a second end of the connector link is connected to an inner end of the spring rod.

6. The appliance hinge assembly as set forth in claim 5, wherein said connector link is pivotally connected to the base between the opposite first and second ends of the connector link such that said follower and said inner end of said spring rod move in opposite directions with respect to a longitudinal axis of the spring rod when said location of said cam follower on said cam profile edge changes.

7. The appliance hinge assembly as set forth in claim 6, wherein said second end of said connector link is connected to said spring rod by a rod fastener, and wherein said rod fastener is slidably engaged with said base.

8. The appliance hinge assembly as set forth in claim 7, wherein said base comprises opposite spaced apart first and second side walls that comprise respective first and second elongated slots that are registered with each other, and wherein said rod fastener is slidably engaged with both said first and second elongated slots.

9. The appliance hinge assembly as set forth in claim 5, further comprising a damper connected to said base and adapted to be engaged by and exert a damping force on said cam arm control system when said cam arm moves in said closing direction.

10. The appliance hinge assembly as set forth in claim 9, wherein said damper is engaged by said spring rod of said cam arm control system when said cam arm moves in said closing direction.

11. The appliance hinge assembly as set forth in claim 10, wherein said damper comprises a piston that moves between an extended piston position and a retracted piston position along an axis that is coincident with the spring rod axis.

12. The appliance hinge assembly as set forth in claim 11, wherein said damper is engaged by the inner end of the spring rod when the spring rod moves toward its retracted position.

* * * * *